US009216571B2

(12) United States Patent
Naito et al.

(10) Patent No.: US 9,216,571 B2
(45) Date of Patent: Dec. 22, 2015

(54) LIQUID DISCHARGE APPARATUS AND LIQUID DISCHARGE METHOD

(71) Applicant: Brother Kogyo Kabushiki Kaisha, Nagoya-shi, Aichi-Ken (JP)

(72) Inventors: Kyohei Naito, Nagoya (JP); Mizuyo Takebayashi, Nagoya (JP); Keiji Kura, Chita (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/455,140

(22) Filed: Aug. 8, 2014

(65) Prior Publication Data

US 2015/0091962 A1 Apr. 2, 2015

(30) Foreign Application Priority Data

Sep. 30, 2013 (JP) ..... 2013-203890

(51) Int. Cl.

*B41J 29/38* (2006.01)
*B41J 2/045* (2006.01)
*B41J 2/14* (2006.01)

(52) U.S. Cl.

CPC ..... *B41J 2/04588* (2013.01); *B41J 2/04581* (2013.01); *B41J 2/04593* (2013.01); *B41J 2/14233* (2013.01); *B41J 2002/14258* (2013.01); *B41J 2002/14491* (2013.01)

(58) Field of Classification Search

CPC ..... B41J 2002/14491; B41J 2/14233; B41J 2/04581; B41J 2/14209; B41J 2/04588; B41J 2/04541; B41J 2/14201; B41J 2002/14258

USPC ..... 347/9, 10, 11, 68, 70, 71

See application file for complete search history.

(56) References Cited

U.S. PATENT DOCUMENTS

2013/0235122 A1* 9/2013 Hiwada et al. ..... 347/54

FOREIGN PATENT DOCUMENTS

JP 2012-206442 10/2012

* cited by examiner

*Primary Examiner* — Jannelle M Lebron

(74) *Attorney, Agent, or Firm* — Frommer Lawrence & Haug LLP

(57) ABSTRACT

A liquid discharge apparatus is provided, comprising a channel structure; a piezoelectric actuator which has a plurality of individual electrodes, a common electrode, and a piezoelectric layer sandwiched between the individual electrodes and the common electrode; and a driving device which drives the piezoelectric actuator. The driving device outputs an individual driving signal which causes a change of an electric potential of the individual electrode, to the individual electrode corresponding to the nozzle for discharging the liquid. Further, the driving device outputs a common driving signal which causes a change of an electric potential of the common electrode in synchronization with the change of the electric potential of the individual electrode into which the individual driving signal is inputted, to the common electrode.

10 Claims, 10 Drawing Sheets

LIQUID DISCHARGE APPARATUS AND LIQUID DISCHARGE METHOD

CROSS REFERENCE TO RELATED APPLICATION

The present application claims priority from Japanese Patent Application No. 2013-203890, filed on Sep. 30, 2013, the disclosure of which is incorporated herein by reference in its entirety.

BACKGROUND

1. Field of the Invention

The present invention relates to a liquid discharge apparatus and a liquid discharge method based on the use of the same.

2. Description of the Related Art

An ink-jet head is known as a liquid discharge apparatus, the ink-jet head comprising a channel unit which is formed with ink channels including a plurality of nozzles, and a piezoelectric actuator which discharges ink from the plurality of nozzles respectively. The channel unit has a plurality of pressure chambers which are communicated with the plurality of nozzles respectively. The piezoelectric actuator is joined to the channel unit so that the plurality of pressure chambers are covered therewith.

The piezoelectric actuator has a piezoelectric layer, a plurality of individual electrodes, and a common electrode. The plurality of individual electrodes are provided while corresponding to the plurality of pressure chambers respectively on a surface of the piezoelectric layer disposed on the side opposite to the channel unit. The common electrode is arranged so that the common electrode is commonly opposed to the plurality of individual electrodes with the piezoelectric layer intervening therebetween, on a surface of the piezoelectric layer disposed on the side of the channel unit. The plurality of individual electrodes are connected to a driver IC for driving the piezoelectric actuator via a wiring member. Further, the common electrode is always retained at the ground electric potential.

The driver IC outputs the driving signal to the individual electrode corresponding to the nozzle from which the ink is to be discharged so that the electric potential of the individual electrode is switched between the driving electric potential and the ground electric potential. Accordingly, the voltage, which is applied to the portion of the piezoelectric layer interposed between the individual electrode and the common electrode (hereinafter referred to as "piezoelectric element" as well), is changed. In this situation, the contraction occurs in the piezoelectric element, and the piezoelectric actuator is deformed so that the piezoelectric actuator is warped or bent. Accordingly, the volume of the pressure chamber is changed, and the discharge energy is applied to the ink contained in the pressure chamber.

SUMMARY

In the piezoelectric actuator described above, the larger the deformation amount of each of the piezoelectric elements is, the larger the volume change of the corresponding pressure chamber is, wherein it is possible to apply the larger discharge energy to the liquid. However, when only the electric potential of the individual electrode is changed by the driver IC as in the piezoelectric actuator as described above, there has been a limit even if it is intended to increase the deformation amount of the piezoelectric element.

An object of the present teaching is to provide a liquid discharge apparatus which makes it possible to increase the deformation of each of piezoelectric elements of a piezoelectric actuator, and a liquid discharge method which is based on the use of the same.

According to a first aspect of the present teaching, there is provided a liquid discharge apparatus for discharging a liquid, including:

a channel structure in which a plurality of liquid channels including a plurality of nozzles is formed;

a piezoelectric actuator which is formed on the channel structure and which is configured so that discharge energy is applied to the liquid contained in the nozzles to discharge the liquid from the plurality of nozzles respectively, the piezoelectric actuator including:

a plurality of individual electrodes which correspond to the plurality of nozzles respectively and each of which is configured to be subjected to an electric potential, separately;

a common electrode which is configured to be subjected to a common electric potential; and a piezoelectric layer which is sandwiched between each of the individual electrodes and the common electrode; and a driving device which is configured to drive the piezoelectric actuator, the driving device being configured so that:

an individual driving signal, which causes a change of an electric potential of the individual electrodes, is output to each of the individual electrodes corresponding to one of the nozzles for discharging the liquid; and a common driving signal, which causes a change of an electric potential of the common electrode in synchronization with the change of the electric potential of the individual electrodes into which the individual driving signal is input, is output to the common electrode.

In the present teaching, when the liquid is discharged from a certain nozzle, the driving device outputs the individual driving signal to the individual electrode corresponding to the nozzle for discharging the liquid. On the other hand, the driving device also outputs the common driving signal to the common electrode so that the electric potential of the common electrode is changed corresponding to the change of the electric potential of the individual electrode. Accordingly, it is possible to deform the piezoelectric element more greatly. In the present teaching, the phrase "common electrode is commonly provided for the plurality of piezoelectric elements" means that the same electric potential is applied to portions of the common electrode corresponding to the plurality of piezoelectric elements respectively.

According to a second aspect of the present teaching, there is provided a liquid discharge method for discharging liquid by using a liquid display apparatus, the liquid display apparatus including:

a channel structure in which a plurality of liquid channels including a plurality of nozzles is formed; and a piezoelectric actuator which is formed on the channel structure and which is configured so that discharge energy is applied to the liquid contained in the nozzles to discharge the liquid from the plurality of nozzles respectively, the piezoelectric actuator including:

a plurality of individual electrodes which correspond to the plurality of nozzles respectively and each of which is configured to be subjected to an electric potential, separately;

a common electrode which is configured to be subjected to a common electric potential; and a piezoelectric layer which is sandwiched between each of the individual electrodes and the common electrode; and the method including:

outputting an individual driving signal which causes a change of an electric potential of the individual electrodes, to each of the individual electrodes corresponding to one of the nozzles for discharging the liquid; and outputting a common driving signal which causes a change of an electric potential of the common electrode in synchronization with the change of the electric potential of the individual electrodes into which the individual driving signal is input, to the common electrode.

DESCRIPTION OF THE EMBODIMENTS

Next, an embodiment of the present teaching will be explained. An explanation will be made with reference to FIGS. 1 and 2 about a schematic arrangement of a printer 1. In the following description, the front side of the paper surface of FIG. 1 is defined as "upward", and the back side of the paper surface is defined as "downward",

Schematic Arrangement of Printer

Figure 1:
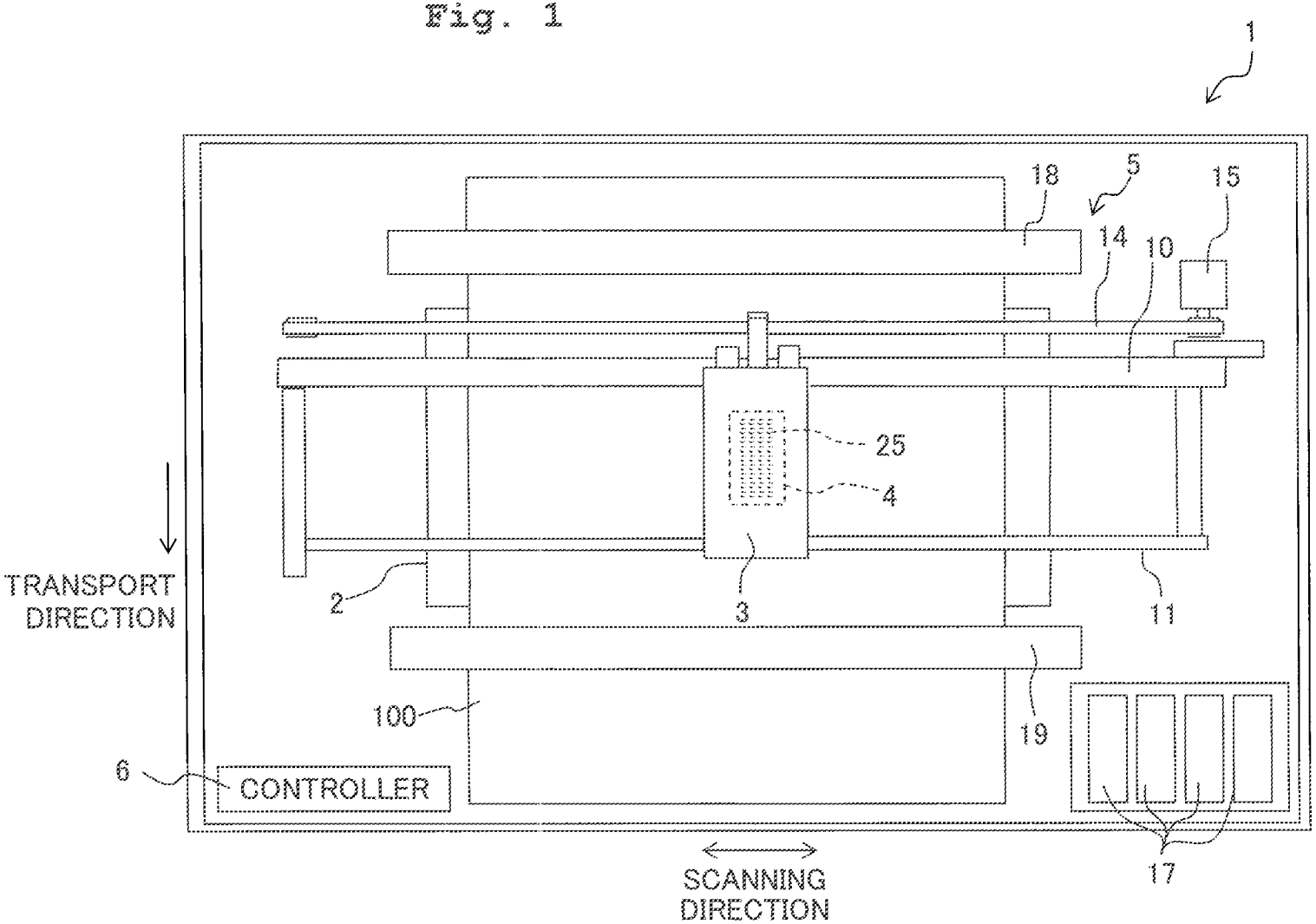
FIG. 1 shows a schematic plan view illustrating a printer of an embodiment of the present teaching.

As shown in FIG. 1, the printer 1 includes, for example, a platen 2, a carriage 3, an ink-jet head 4, a transport mechanism 5, and a controller 6.

Recording paper 100 as a recording medium is placed on the upper surface of the platen 2. The carriage 3 is configured so that the carriage 3 is reciprocatively movable in the scanning direction along two guide rails 10, 11 in an area opposed to the platen 2. An endless belt 14 is connected to the carriage 3. The endless belt 14 is driven by a carriage driving motor 15, and thus the carriage 3 is moved in the scanning direction.

The ink-jet head 4 is attached to the carriage 3, and the ink-jet head 4 is movable in the scanning direction together with the carriage 3. The ink-jet head 4 is connected by the tubes (not shown) to ink cartridges 17 of four colors (for example, black, yellow, cyan, and magenta) installed to the printer 1. Further, a plurality of nozzles 25 are formed on the lower surface of the inkjet head 4 (surface disposed on the back side of the paper-plane of FIG. 1). The four color inks, which are supplied from the ink cartridges 17, are discharged by the inkjet head 4 from the plurality of nozzles 25 toward the recording paper 100 placed on the platen 2.

The transport mechanism 5 has two transport rollers 18, 19 which are arranged to interpose the platen 2 in the transport direction therebetween. The transport rollers 18, 19 are driven in synchronization with each other by a transport motor 16 (see FIG. 2). The transport mechanism 5 transports the recording paper 100 placed on the platen 2 in the transport direction by means of the two transport rollers 18, 19.

Figure 2:
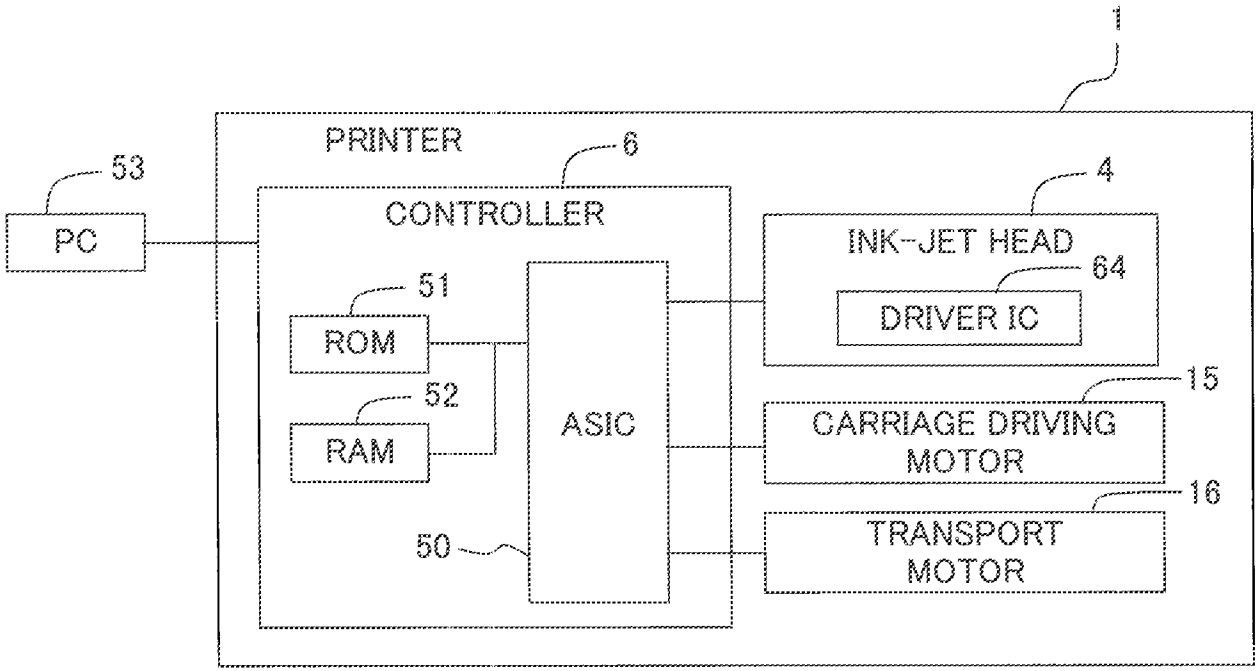
FIG. 2 shows a block diagram schematically illustrating an electric arrangement of the printer.

As shown in FIG. 2, the controller 6 includes, for example, Application Specific Integrated Circuit 50 (ASIC 50), and Read Only Memory 51 (ROM 51) and Random Access Memory 52 (RAM 52) which are connected to ASIC 50. Further, the controller 6 is connected to PC 53 as an external apparatus so that the data communication can be performed.

The controller 6 executes various processes including, for example, the printing on the recording paper 100 by means of ASIC 50 in accordance with a program stored in ROM 51. For example, in the printing process, the controller 6 controls, for example, the inkjet head 4, the carriage driving motor 15, and the transport motor 16 on the basis of a printing instruction inputted from PC 53 to print, for example, an image on the recording paper 100. Specifically, the controller 6 alternately causes the execution of the ink discharge operation in which the inks are discharged while moving the inkjet head 4 in the scanning direction together with the carriage 3 and the execution of the transport operation in which the recording paper 100 is transported by a predetermined amount in the transport direction by means of the transport rollers 18, 19. The foregoing explanation refers to an example in which the controller 6 performs or executes various processes by means of ASIC 50. However, the present teaching is not limited thereto. The construction of the controller 6 can be appropriately changed. For example, the controller 6 may be realized by any hardware configuration. For example, the function may be shared by two or more ASIC's to realize the process.

Details of Inkjet Head

Figure 3:
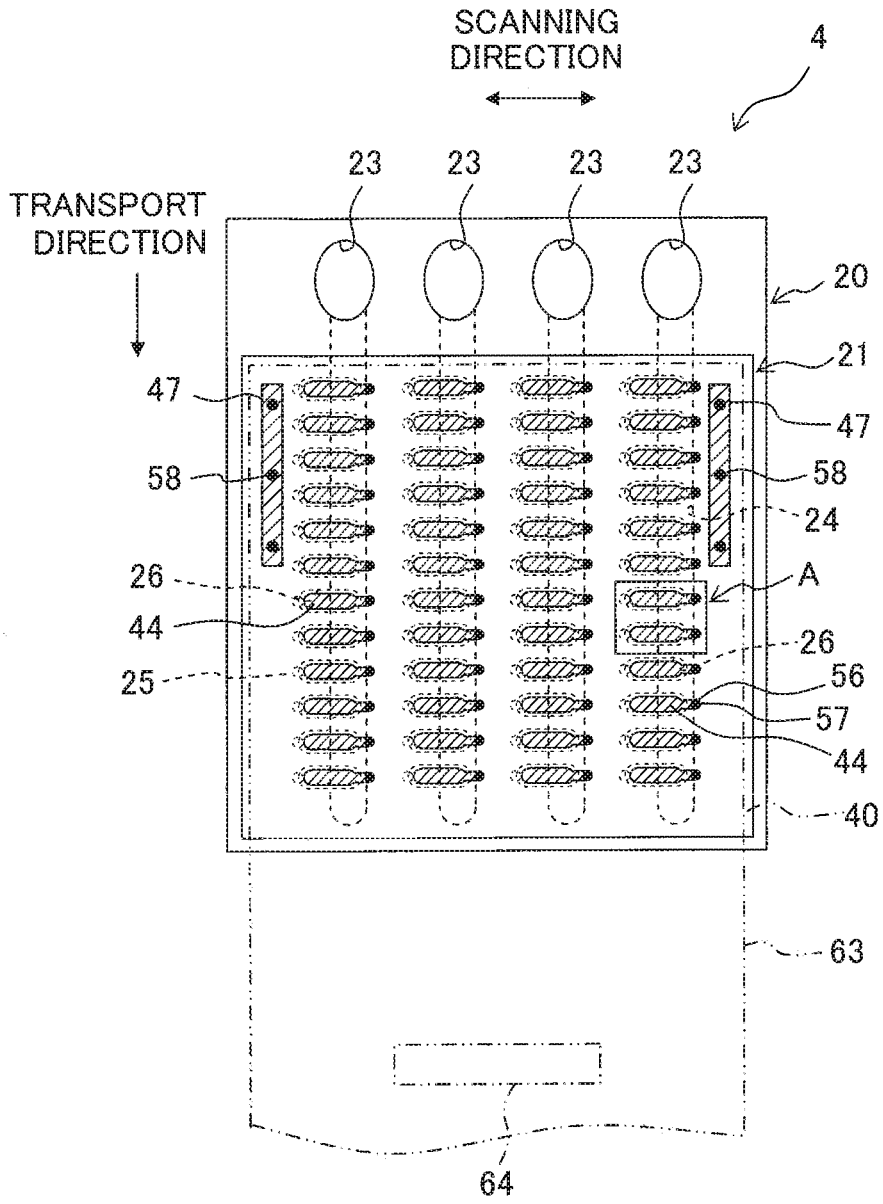
FIG. 3 shows a plan view illustrating an inkjet head.
Figure 4:
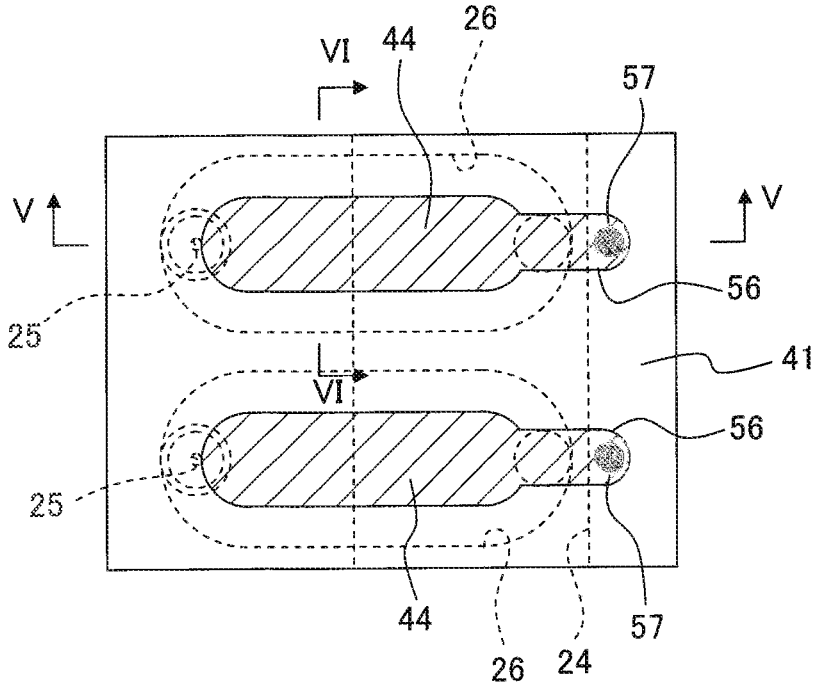
FIG. 4 shows an enlarged view illustrating Portion A shown in FIG. 3.
Figure 5:
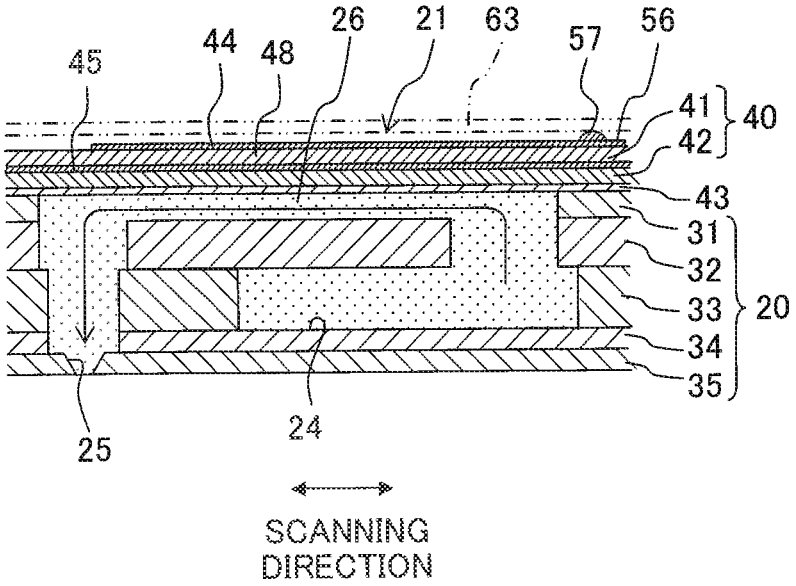
FIG. 5 shows a sectional view taken along a line V-V shown in FIG. 4.
Figure 6:
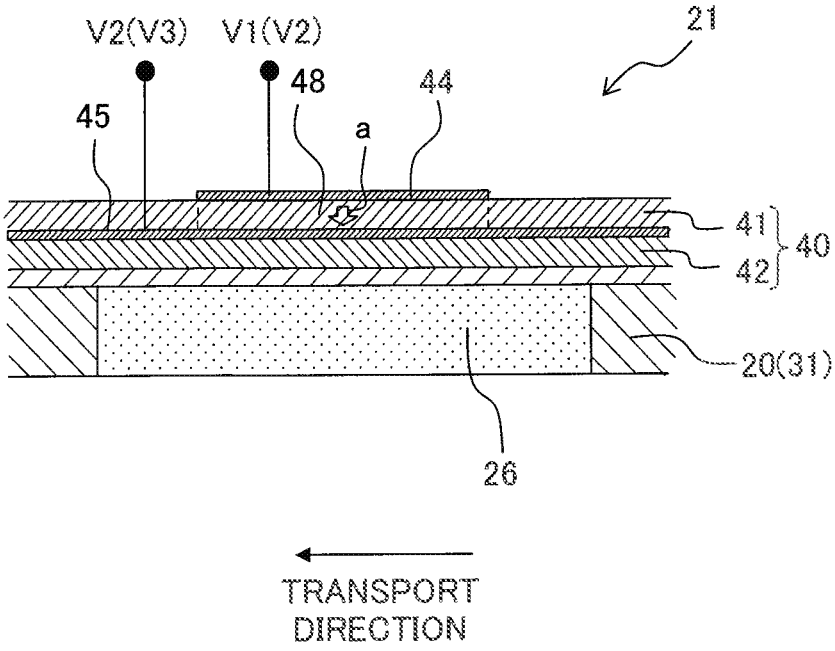
FIG. 6 shows a sectional view taken along a line VI-VI shown in FIG. 4.

Next, the ink-jet head 4 will be explained. In FIGS. 3 and 5, COF 63, which is connected to a piezoelectric actuator 21, is schematically depicted by two-dot chain lines. In FIG. 6, the channel structure of those disposed under or below a pressure chamber 26, which is shown in FIG. 5, is omitted from the illustration. As shown in FIGS. 3 to 6, the inkjet head 4 includes a channel unit 20, the piezoelectric actuator 21, and a driver IC 64.

Construction of Channel Unit

As shown in FIG. 5, the channel unit 20 is formed by mutually stacking five plates 31 to 35 which are formed with channel-forming holes respectively. The five plates 31 to 35 are stacked so that the respective channel-forming holes are communicated with each other. In this way, ink channels are formed in the channel unit 20 as described below.

As shown in FIG. 3, four ink supply holes 23, which are connected to the four ink cartridges 17 (see FIG. 1), are formed on the upper surface of the channel unit 20. Four manifolds 24, which are connected to the four ink supply holes 23 respectively, are formed in the channel unit 20. The four color inks contained in the four ink cartridges 17 are supplied respectively to the four manifolds 24 via the four ink supply holes 23. The four manifolds 24 extend in the transport direction respectively.

A plurality of nozzles 25 are formed in a plate 35 disposed at the lowermost layer of the channel unit 20. A plurality of pressure chambers 26 are formed in a plate 31 disposed at the uppermost layer. As shown in FIG. 3, the plurality of nozzles 25 are arranged in the transport direction on the lower surface of the channel unit 20 (surface disposed on the back side of the paper-plane of FIG. 3) to form four arrays of nozzle arrays corresponding to the four manifolds 24 respectively.

The plurality of pressure chambers 26 are arranged in a planar form along the upper surface of the channel unit 20. The plurality of pressure chambers 26 are covered, at upper positions, with a piezoelectric member 40 of the piezoelectric actuator 21 joined to the upper surface of the channel unit 20. Further, the plurality of pressure chambers 26 are arranged in four arrays corresponding to the four manifolds 24 and the four arrays of nozzle arrays. Each of the pressure chambers 26 has a substantially an elliptical shape which is elongated in the scanning direction as viewed in a plan view. One end of each of the pressure chambers 26 in the longitudinal direction is communicated with the manifold 24, and the other end in the longitudinal direction is communicated with the nozzle 26. Accordingly, as shown in FIG. 5, a plurality of individual ink channels, which are branched from the manifolds 24 to arrive at the nozzles 25 via the pressure chambers 26, are formed in the channel unit 20.

Construction of Piezoelectric Actuator

The piezoelectric actuator 21 is joined to the upper surface of the channel unit 20 so that the plurality of pressure chambers 26 are covered therewith. As shown in FIGS. 3 to 6, the piezoelectric actuator 21 includes an ink sealing film 43, the piezoelectric member 40 which is formed by two piezoelectric layers 41, 42, a plurality of individual electrodes 44, and a common electrode 45.

The ink sealing film 43 is a thin film formed of a material having low ink permeability including, for example, a metal material such as stainless steel or the like. The ink sealing film 43 is joined to the upper surface of the channel unit 20 so that the plurality of pressure chambers 26 are covered therewith.

Each of the two piezoelectric layers 41, 42 for constructing the piezoelectric member 40 is composed of a piezoelectric material containing a main component of lead titanate zirconate as mixed crystal of lead titanate and lead zirconate. The piezoelectric layers 41, 42 are arranged on the upper surface of the ink sealing film 43 in a state of being mutually stacked. The piezoelectric member 40 can be obtained, for example, such that the individual electrodes 44 and the common electrode 45 are formed, for example, by means of the printing on two unsintered green sheets, and then the two green sheets are stacked and sintered. However, the method for forming the piezoelectric member 40 is not limited to the method described above, which may be appropriately changed.

The plurality of individual electrodes 44 are arranged on the upper surface of the piezoelectric layer 41 disposed at the upper layer. In particular, as shown in FIGS. 3 to 6, the respective individual electrodes 44 are arranged in the areas of the upper surface of the piezoelectric layer 41 opposed to central positions of the pressure chambers 26. The plurality of individual electrodes 44 are arranged in the transport direction corresponding to the plurality of pressure chambers 26 to constitute four arrays of individual electrode arrays. Individual terminals 56 are led out from the respective individual electrodes 44. Further, bumps 57, each of which is composed of a conductive material such as gold or the like, are provided at end portions of the individual terminals 56. As shown in FIG. 5, COF 63, which is a wiring member, is pressed against and joined to the bumps 57. Accordingly, the individual terminals 56 are electrically connected to the wirings formed on COF 63 via the humps 57.

The common electrode 45 is arranged between the two piezoelectric layers 41, 42, and the common electrode 45 is provided commonly for the plurality of individual electrodes 44. In particular, the common electrode 45 is commonly opposed to the plurality of individual electrodes 44 with the piezoelectric layer 41 intervening therebetween. Accordingly, the same electric potential is applied to all of a plurality of electrode portions of the common electrode 45 opposed to the plurality of individual electrodes 44 respectively.

As shown in FIG. 3, two leading electrodes 47 are provided respectively at both end portions in the scanning direction of the upper surface of the piezoelectric layer 41 disposed at the upper layer. The two leading electrodes 47 are in conduction with the common electrode 45 disposed between the two piezoelectric layers 41, 42 via a plurality of plated through-holes (not shown) formed through the piezoelectric layer 41. Further, a plurality of humps 58 are provided on the leading electrodes 47. The two leading electrodes 47 are electrically connected to the wirings formed on COF 63 via the plurality of bumps 58.

The portion of the piezoelectric layer 41, which is interposed between the individual electrode 44 and the common electrode 45, is polarized downwardly in the thickness direction, i.e., in the direction directed from the individual electrode 44 to the common electrode 45, as indicated by the blanked arrow a in FIG. 6. The polarized portion of the piezoelectric layer 41 is contracted or elongated in the in-plane direction of the piezoelectric layer 41 which is the direction perpendicular to the polarization direction and the electric field direction when the electric field is allowed to act in the direction parallel to the polarization direction. The portion of the piezoelectric layer 41, which is interposed between the individual electrode 44 and the common electrode 45, is hereinafter referred to as "piezoelectric element 48". The plurality of piezoelectric elements 48, which correspond to the plurality of pressure chambers 26 respectively, exist in the piezoelectric layer 41.

Driver IC

Next, the driver IC 64 will be explained. As shown in FIG. 3, the driver IC 64 is mounted on COF 63 which is the wiring member. Further, COF 63 is connected to the plurality of bumps 57, 58 (see FIGS. 3 and 5) formed on the upper surface of the piezoelectric layer 41. Accordingly, the driver IC 64 is connected to the plurality of individual electrodes 44 and the common electrode 45 of the piezoelectric actuator 21 via the wirings formed on COF 63.

The driver IC 64 outputs an individual driving signal to the individual electrode 44 corresponding to the nozzle 25 for discharging the ink so that the electric potential of the individual electrode 44 is changed. Further, the driver IC 64 also outputs a common driving signal to the common electrode 45 so that the electric potential of the common electrode 45 is changed. In this way, the electric potentials of the individual electrode 44 and the common electrode 45 are changed by the driver IC 64. Thus, the electric field in the thickness direction is allowed to act on the piezoelectric element 48 interposed between the individual electrode 44 and the common electrode 45 so that the piezoelectric deformation is caused in the piezoelectric element 48.

Figure 7:
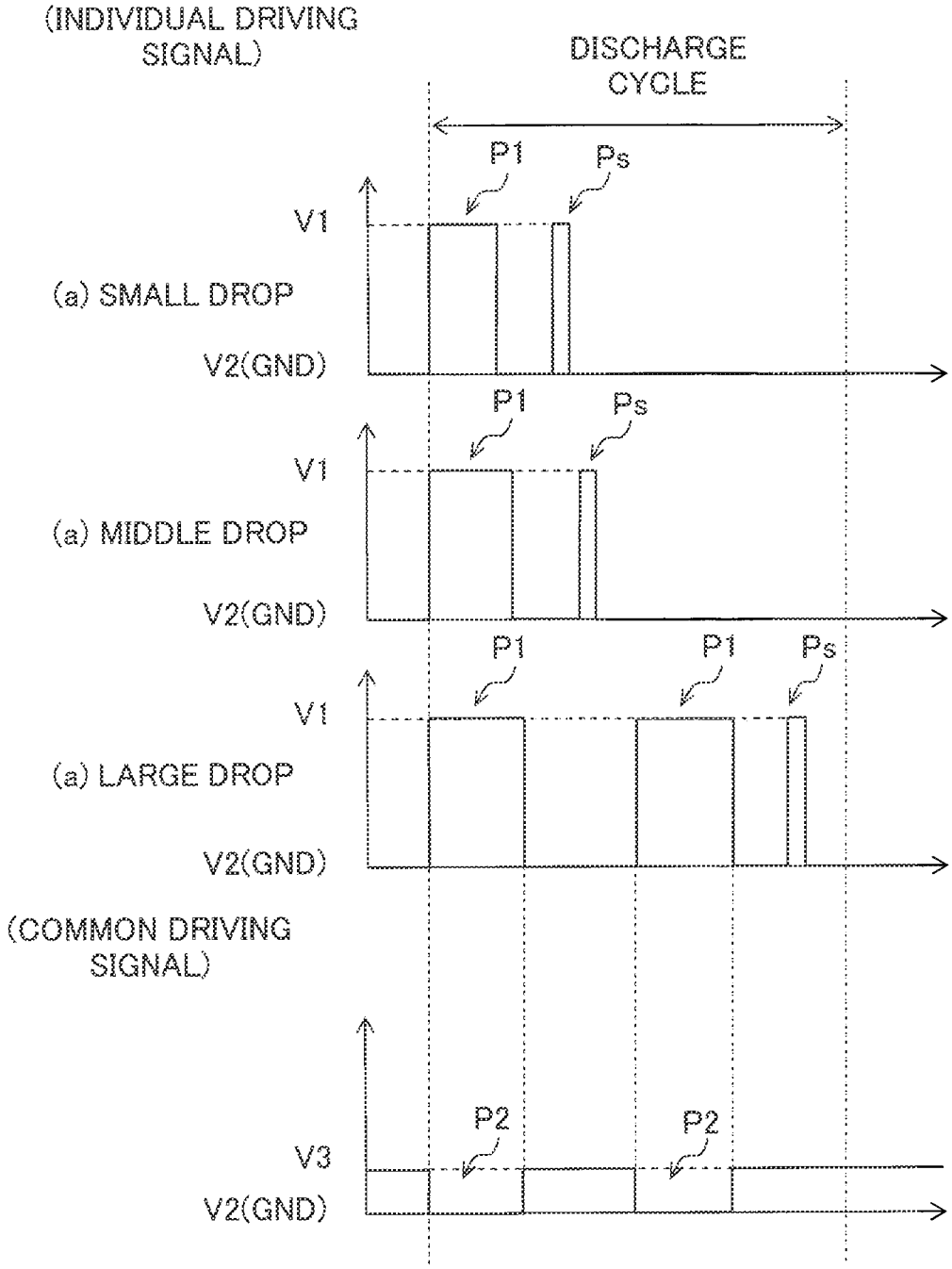
FIG. 7 shows waveforms of individual driving signals and a common driving signal.

The discharge cycle shown in FIG. 7 indicates the time for forming one dot (pixel) on the recording paper 100 by means of one nozzle 25. As shown in FIG. 7, the driver IC 64 of the embodiment of the present teaching is configured so that three types of the individual driving signals, which correspond to three types of ink discharge amounts (small drop, middle drop, large drop) respectively, can be generated in order to realize the gradation printing by changing the amount of the ink discharged from one nozzle 25. The driver IC 64 generates and outputs one type of the signal selected from the three types of the individual driving signals, with respect to the individual electrode 44 corresponding to the nozzle 25 for discharging the ink, on the basis of the control signal fed from the controller 6.

The three types of the individual driving signals have individual discharge pulses P1 respectively. When the individual discharge pulse P1 is applied to the individual electrode 44, the electric potential of the individual electrode 44 is thereby switched in an order of "second electric potential V2→first electric potential V1→second electric potential V2". In the embodiment of the present teaching, the second electric potential V2 is the ground electric potential (GND), and the first electric potential V1 is a positive electric potential higher than the second electric potential V2. As will be described later on as well, the piezoelectric element 48 is deformed in accordance with the electric potential change of the individual electrode 44 caused by the application of the individual discharge pulse P1, and thus the pressure wave is generated in the pressure chamber 26 to apply the discharge energy to the ink. The three types of the individual driving signals have stabilizing pulses Ps in addition to the individual discharge pulses P1. The stabilizing pulse Ps is a pulse which is output after the individual discharge pulse P1 and which has a pulse width smaller than that of the individual discharge pulse P1. The stabilizing pulse Ps is the pulse which is applied in order to attenuate the pressure fluctuation of the ink caused by the individual discharge pulse P1.

Each of the individual driving signal for the small drop and the individual driving signal for the middle drop has one individual discharge pulse P1 in one discharge cycle. However, the pulse width of the individual discharge pulse P1 of the individual driving signal for the small drop is smaller than the pulse width of the individual discharge pulse P1 of the individual driving signal for the middle drop. On account of the difference in the pulse width, the ink discharge amount from the nozzle 25, which is provided when the individual driving signal for the small drop is output to the individual electrode 44, is smaller than that provided when the individual driving signal for the middle drop is output. Further, the individual driving signal for the large drop has the two individual discharge pulses P1. Accordingly, the ink discharge amount from the nozzle 25, which is provided when the individual driving signal for the large drop is output to the individual electrode 44, is larger than those provided when the individual driving signals for the small drop and the middle drop are output. The waveforms of the individual driving signals shown in FIG. 7 are examples in a persistent manner. The waveform can be appropriately changed depending on the amount of the ink to be discharged, for example, in relation to the number of the individual discharge pulse(s) P1, the pulse width, and/or the presence or absence of the stabilizing pulse Ps. For example, it is not necessarily indispensable that the number of the individual discharge pulses P1 of the individual driving signal for the large drop should be two. It is also allowable that the number is one or three or more.

Further, the driver IC 64 generates one type of the common driving signal. The common driving signal is a signal which changes the electric potential of the common electrode 45 in accordance with the change of the electric potential of the individual electrode 44 to which the individual driving signal for the large drop is output.

The common driving signal will be specifically explained. As shown in FIG. 7, the common driving signal has two common discharge pulses P2 which correspond to the two individual discharge pulses P1 of the individual driving signal for the large drop. When the common discharge pulses P2 are applied to the common electrode 45, the electric potential of the common electrode 45 is switched thereby in an order of "third electric potential V3→second electric potential V2→third electric potential V3". The third electric, potential V3 is an electric potential which is intermediate between the first electric potential V1 and the second electric potential V2. That is, the magnitude correlation among the three types of the electric potentials V1, V2, V3 is given as "first electric potential V1>third electric potential V3>second electric potential V2 (GND)". Further, any pulse, which corresponds to the stabilizing pulse Ps of the individual driving signal for the large drop, does not exist in the common driving signal. In other words, the electric potential of the common electrode 45 is not changed at the timing at which the stabilizing pulse Ps is applied to the individual electrode 44.

Further, the electric potential change (third electric potential V3→second electric potential V2) of the common electrode 45 to which the common driving signal having the common discharge pulse P2 is output is smaller than the electric, potential change (second electric potential V2→first electric potential V1) of the individual electrode 44 to which the individual driving signal having the individual discharge pulse P1 is output.

Further, the pulse width of the individual discharge pulse P1 of the individual driving signal for the large drop is equal to the pulse width of the common discharge pulse P2 of the common driving signal. Further, the timing of the individual discharge pulse P1 is also equal to the timing of the common discharge pulse P2. In other words, the driver IC 64 applies the individual discharge pulse P1 to the individual electrode 44 corresponding to the nozzle 25 for discharging the large drop, simultaneously with which the driver IC 64 applies the common discharge pulse P2 to the common electrode 45. Accordingly, the timing, at which the electric potential of the individual electrode 44 is changed by the application of the individual discharge pulse P1, is the same as the timing at which the electric potential of the common electrode 45 is changed by the application of the common discharge pulse P2. In FIG. 7, the two common discharge pulses P2 are applied so that the two common discharge pulses P2 are synchronized with both of the two individual discharge pulses P1 of the individual driving signal for the large drop. However, the present teaching is not limited to the complete synchronization between the individual discharge pulse P1 of the individual driving signal for the large drop and the common discharge pulse P2. For example, in the example shown in FIG. 7, one common discharge pulse P2 may be applied so that the one common discharge pulse P2 is synchronized with any one of the two individual discharge pulses P1 of the individual driving signal for the large drop. In other words, when the individual driving signal for the large drop includes one individual discharge pulse P1 or a plurality of individual discharge pulses P1, the common discharge pulse P2 may be applied so that the common discharge pulse P2 is synchronized with at least one individual discharge pulse P1.

Next, an explanation will be made about the deformation operation of the piezoelectric element 48 performed when the individual driving signal and the common driving signal are output from the driver IC 64 to the piezoelectric actuator 21.

With reference to FIG. 8, the arrows b indicate the direction of the electric field allowed to act on the piezoelectric element 48 respectively, and the arrows c indicate the deformation directions (direction of elongation or contraction) in the in-plane direction of the piezoelectric element 48. FIG. 8 shows such a situation that the individual driving signal for the large drop shown in FIG. 7 is output to the individual electrode 44, and the common driving signal is output to the common electrode 45.

Figure 8A:
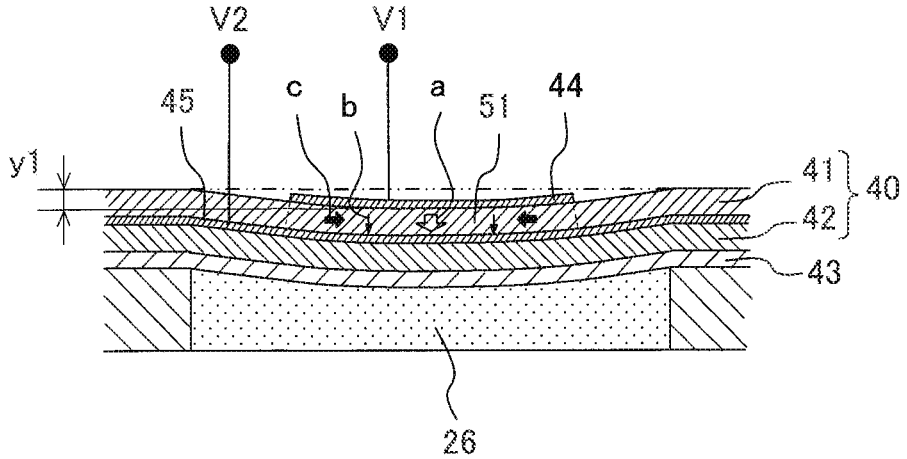
FIGS. 8A and 8B illustrate the operation of a piezoelectric actuator.

When the individual discharge pulse P1 is applied to the individual electrode 44, the electric potential of the individual electrode 44 is raised from the second electric potential V2 to the first electric potential V1 as shown in FIG. 8A. Simultaneously, the common discharge pulse P2 is applied to the common electrode 45, and the electric potential of the common electrode 45 is conversely lowered from the third electric potential V3 to the second electric potential V2. The state of the piezoelectric element 48 shown in FIG. 8A is referred to as "first state" for the convenience of explanation, The first electric potential V1, which is applied to the individual electrode 44, is the higher electric potential of the two types of the electric potentials to be applied to the individual electrode 44. The second electric potential V2, which is applied to the common electrode 45, is the lower electric potential of the two types of the electric potentials to be applied to the common electrode 45. Therefore, in the first state, the large electric potential difference (V1−V2) arises between the individual electrode 44 and the common electrode 45. The strong electric field, which is directed downwardly from the individual electrode 44 to the common electrode 45, is allowed to act on the piezoelectric element 48 interposed between the both electrodes as shown by the arrows B. Further, as shown by the arrow a, the polarization direction of the piezoelectric element 48 is also directed downwardly. Therefore, the electric field (forward electric field or positive electric field), in which the direction of the electric field is the same as the polarization direction, is allowed to act on the piezoelectric element 48. Therefore, the piezoelectric element 48 is contracted in the in-plane direction as shown by the arrows c. When the piezoelectric element 48, which is opposed to the central portion of the pressure chamber 26, is contracted in the in-plane direction, then the piezoelectric member 40 is bent thereby so that the piezoelectric member 40 protrudes toward the side of the pressure chamber 26 (toward the lower side), and the piezoelectric member 40 is displaced in the downward direction at the central position of the pressure chamber 26. The displacement amount in the downward direction of the piezoelectric member 40, which is provided in this situation, is designated as "y1".

Figure 8B:
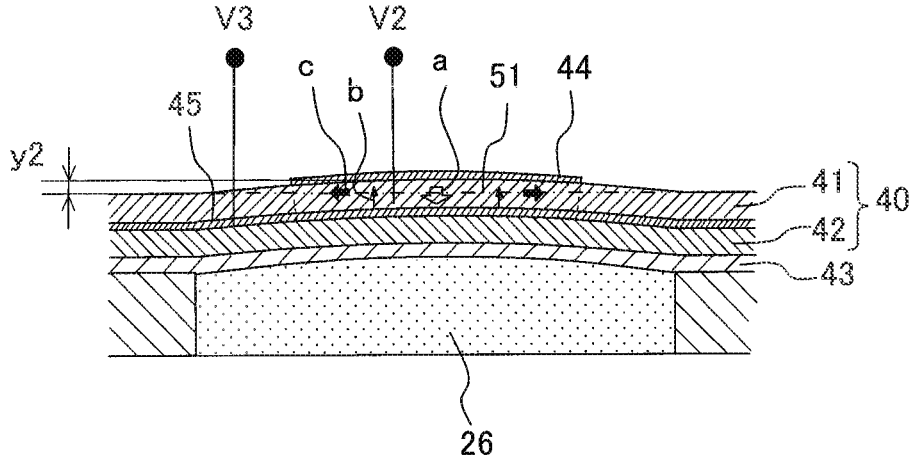

When the time, which corresponds to the pulse width of the individual discharge pulse P1, elapses, the electric potential of the individual electrode 44 is lowered from the first electric potential V1 to the second electric potential V2 as shown in FIG. 8B. Simultaneously, the electric potential of the common electrode 45 is conversely raised from the second electric potential V2 to the third electric potential V3. The state of the piezoelectric element 48 shown in FIG. 8B is referred to as "second state" as compared with the "first state" shown in FIG. 8A. Also in the second state, the electric potential difference (V3−V2) arises between the individual electrode 44 and the common electrode 45. However, in this case, the electric potential of the common electrode 45 is higher than the electric potential of the individual electrode 44. Therefore, as shown by the arrows b, the electric field, which is directed upwardly from the common electrode 45 to the individual electrode 44, is allowed to act on the piezoelectric element 48 conversely to the situation shown in FIG. 8A. The electric field is the electric field (reverse electric field or field reversing) which is directed reversely or oppositely to the polarization direction of the piezoelectric element 48 indicated by the arrow a. Therefore, the piezoelectric element 48 is elongated in the in-plane direction as shown by the arrows c. In this way, when the piezoelectric element 48, which is opposed to the central portion of the pressure chamber 26, is elongated in the in-plane direction, then the piezoelectric member 40 is thereby warped so that the piezoelectric member 40 protrudes toward the opposite side (upper side) with respect to the pressure chamber 26, and the piezoelectric member 40 is displaced in the upward direction at the central position of the pressure chamber 26. The displacement amount in the upward direction of the piezoelectric member 40, which is provided in this situation, is designated as "y2".

As described above, the piezoelectric member 40 is displaced upwardly and downwardly between the situations provided before and after the switching of the state of the piezoelectric member 40 between the first state shown in FIG. 8A and the second state shown in FIG. 8B in accordance with the application of the discharge pulses P1, P2. That is, the total displacement amount y of the central portion of the piezoelectric member 40, which is brought about between the situations provided before and after the switching between the first state and the second state, is y1+y2. The volume of the pressure chamber 26 is changed in accordance with the displacement of the piezoelectric member 40. Accordingly, the pressure (discharge energy) is applied to the ink contained in the pressure chamber 26, and the ink is discharged from the nozzle 25 communicated with the pressure chamber 26.

Further, the total displacement amount y (=y1+y2) of the piezoelectric member of the embodiment of the present teaching, by which the electric potential of the common electrode 45 is changed, is larger than the displacement amount of the piezoelectric member which is provided when the electric potential of the common electrode 45 is constant. An explanation will be made below about a case in which the electric potential of the common electrode 45 is constant at the second electric potential V2 and a case in which the electric potential of the common electrode 45 is constant at the third electric potential V3 respectively.

<a> Case in which Electric Potential of Common Electrode 45 is Constant at Second Electric Potential V2.

In this case, when the electric potential of the individual electrode 44 is the first electric potential V1, the electric potential difference between the individual electrode 44 and the common electrode 45 is (V1−V2). Therefore, the displacement amount y in the downward direction shown in FIG. 8A is the same as that of the embodiment of the present teaching. However, when the electric potential of the individual electrode 44 is the second electric potential V2, then the electric potential of the individual electrode 44 is the same as that of the common electrode 45, and the piezoelectric element 48 is not deformed. In other words, the displacement amount y in the upward direction shown in FIG. 8B is not generated. In other words, the total displacement amount y of the piezoelectric member 40 provided in this case is only y1 shown in FIG. 8A, which is smaller than the total displacement amount y provided in the embodiment of the present teaching.

<b> Case in which Electric Potential of Common Electrode 45 is Constant at Third Electric Potential V3

In this case, when the electric potential of the individual electrode 44 is the second electric potential V2, the electric potential difference between the individual electrode 44 and the common electrode 45 is (V3−V2). Therefore, the displacement amount y2 in the upward direction shown in FIG. 8B is the same as that of the embodiment of the present teaching. However, when the electric potential of the individual electrode 44 is the first electric potential V1, the electric potential difference between the individual electrode 44 and the common electrode 45 is (V1−V3) which is smaller than the electric potential difference (V1−V2) provided in the embodiment of the present teaching. Therefore, the displacement amount y1 in the downward direction as shown in FIG. 8A is smaller than that of the embodiment of the present teaching. As a result, the total displacement amount y is small as well.

In other words, when the electric potential of the common electrode 45 is constant, it is possible to realize only one of the increase in the displacement amount y1 as shown in FIG. 8A and the generation of the displacement amount y2 as shown in FIG. 8B. In the embodiment of the present teaching, the displacement amount y2 in the upward direction as shown in FIG. 8B can be also generated while increasing the displacement amount y1 in the downward direction as shown in FIG. 8A by changing the electric potential of the common electrode 45. Therefore, it is possible to increase the total displacement amount y of the piezoelectric member 40.

According to the embodiment of the present teaching as explained above, the following functions and effects are provided.

<1> The driver IC 64 outputs the individual driving signal to the individual electrode 44 corresponding to the nozzle 25 for discharging the ink, while the driver IC 64 also outputs the common driving signal to the common electrode 45 so that the electric potential of the common electrode 45 is changed in accordance with the change of the electric potential of the individual electrode 44 described above. Specifically, the individual discharge pulse P1 is applied to the individual electrode 44, while the common discharge pulse P2 is applied to the common electrode 45. Accordingly, it is possible to increase the electric potential difference between the individual electrode 44 and the common electrode 45 during the application of the individual discharge pulse P1 to the individual electrode 44. The deformation amount of the piezoelectric element 48 shown in FIG. 8A is increased corresponding thereto, and the displacement amount y1 of the piezoelectric member 40 is increased as well. Therefore, it is possible to apply the large discharge energy to the ink.

<2> The electric potential of the individual electrode 44 is the first electric potential V1 in the first state of the piezoelectric element 48 shown in FIG. 8A. The first electric potential V1 is the higher electric potential of the two types of the electric potentials to be applied to the individual electrode 44. Further, the electric potential of the common electrode 45 is the second electric potential V2. The second electric potential V2 is the lower electric potential of the two types of the electric potentials to be applied to the common electrode 45. Therefore, the electric potential difference between the individual electrode 44 and the common electrode 45 is increased, and the strong forward electric field, in which the direction of the electric field is coincident with the polarization direction, is allowed to act on the piezoelectric element 48. On the other hand, in the second state of the piezoelectric element 48 shown in FIG. 8B, the electric potential of the individual electrode 44 is the second electric potential V2, and the electric potential of the common electrode 45 is the third electric potential V3. In this situation, the reverse electric field, in which the direction of the electric field is opposite to the polarization direction, is allowed to act on the piezoelectric element 48. Further, the third electric potential V3 is the intermediate electric potential between the first electric potential V1 and the second electric potential V2. Therefore, the electric potential difference between the individual electrode 44 and the common electrode 45, which is provided in the second state, is smaller than the electric potential difference between the individual electrode 44 and the common electrode 45 which is provided in the first state. In other words, the reverse electric field, which is allowed to act on the piezoelectric element 48 in the second state, is smaller than the forward electric field which is allowed to act on the piezoelectric element 48 in the first state.

According to the above, the strong forward electric field is allowed to act on the piezoelectric element 48 in the first state shown in FIG. 8A, the piezoelectric element 48 is greatly shrunk in the in-plane direction of the piezoelectric layer 41, and the piezoelectric member 40 is greatly displaced in the downward direction. In addition thereto, in the second state shown in FIG. 8B, the reverse electric field is allowed to act on the piezoelectric element 48, the piezoelectric element 48 is elongated in the in-plane direction of the piezoelectric layer 41, and the piezoelectric member 40 is displaced in the upward direction. Therefore, the total displacement amount of the piezoelectric element 48, i.e., the total displacement amount y(=y1+y2) of the piezoelectric member is increased between the situations provided before and after the switching between the first state and the second state. It is possible to apply the large discharge energy to the ink contained in the pressure chamber 26. Further, the reverse electric field, which is allowed to act on the piezoelectric element 48 in the second state, is smaller than the forward electric field which is allowed to act in the first state. Therefore, the polarization of the piezoelectric element 48 is hardly collapsed by the reverse electric field.

<3> In the embodiment of the present teaching, the pulse width of the individual discharge pulse P1 of the individual driving signal is equal to the pulse width of the common discharge pulse P2 of the common driving signal. Further, the application timing, at which the individual discharge pulse P1 is applied to the individual electrode 44, is also the same as the application timing at which the common discharge pulse P2 is applied to the common electrode 45. In other words, the timing, at which the electric potential of the individual electrode 44 is changed, is the same as the timing at which the electric potential of the common electrode 45 is changed. It is possible to instantaneously generate the large electric potential difference between the individual electrode 44 and the common electrode 45. Accordingly, it is possible to greatly deform the piezoelectric element 48 in a short time, and it is possible to apply the large discharge energy to the ink contained in the pressure chamber 26.

<4> In the embodiment of the present teaching, the driver IC 64 generates the three types of the individual driving signals corresponding to the three types of the ink discharge amounts (large drop, middle drop, small drop) respectively in order to perform the gradation printing. In general, in order to increase the amount of the ink discharged from one nozzle 25, it is necessary to apply a large amount of discharge energy to the ink. For this purpose, it is necessary to increase the number of the individual discharge pulses P1. Further, when the pulse width of each of the individual discharge pulses P1 is excessively small, then the pressure wave is hardly generated in the pressure chamber 26, and any discharge energy is hardly applied to the ink. Therefore, it is also necessary to increase the pulse width of the individual discharge pulse P1 to be not less than a certain value. On account of the above, the individual driving signal for the large drop, which is included in the three types of the individual driving signals and which especially provides the maximum ink discharge amount, consequently has the long length, in conformity with which the discharge cycle is consequently lengthened as well.

In the meantime, when one individual driving signal, which is selected from the three types of the individual driving signals, is output to one individual electrode 44, a problem arises such that which signal, that corresponds to any one of the three types of the individual driving signals, is the common driving signal to be output to the common electrode 45. In relation thereto, in the embodiment of the present teaching, the common driving signal is the signal corresponding to the individual driving signal for the large drop for which it is necessary to apply the largest discharge energy to the ink. When the common driving signal is allowed to correspond to the individual driving signal for the large drop as described above, it is possible to thereby increase the displacement amount of the piezoelectric element 48 by changing the electric potential of the common electrode 45 when it is necessary to discharge the largest amount of the ink from the nozzle 25. Accordingly, it is possible to decrease the number of the individual discharge pulses P1 of the individual driving signal for the large drop, and/or it is possible to shorten the pulse width. It is possible to shorten the length of the individual driving signal.

An example will be explained about the shortening or reduction of the discharge cycle. It is assumed that three or more individual discharge pulses P1 are required to be continuously applied to the individual electrode 44 in order to discharge the large drop from the nozzle 25, when only the electric potential of the individual electrode 44 is changed as in the conventional technique. On the contrary, as described above, when the common driving signal is also output to the common electrode 45, then the total displacement amount y of the piezoelectric member 40 is increased thereby, and it is possible to apply the larger discharge energy to the ink by applying one individual discharge pulse P1. Therefore, it is also possible to decrease the number of the individual discharge pulses P1 of the individual driving signal for the large drop to be two as shown in FIG. 7. It is possible to shorten the discharge cycle corresponding to the decrease in the number of the individual discharge pulses P1.

<5> The common driving signal is applied to the common electrode 45 which is provided commonly for the plurality of piezoelectric elements 48. Therefore, the electric potential of the common electrode 45 is changed in relation to not only the piezoelectric element 48 corresponding to the nozzle 25 which discharges the ink but also the piezoelectric element 48 corresponding to the nozzle 25 which does not discharge the ink. However, the electric potential change (third electric potential V3→second electric potential V2) of the common electrode 45 is smaller than the electric potential change (second electric potential V2→first electric potential V1) of the individual electrode 44 provided when the individual driving signal is output. Therefore, in the piezoelectric element 48 corresponding to the nozzle 25 which does not discharge the ink, the electric potential difference is small even when the electric potential difference between the individual electrode 44 and the common electrode 45 is generated. Therefore, the ink is hardly discharged erroneously from the nozzle 25 which is not scheduled to discharge the ink.

Further, the common driving signal, which corresponds to the individual driving signal for the large drop, is also output to the common electrode 45 in relation to the piezoelectric element 48 corresponding to the nozzle 25 which discharges the small drop or the middle drop. However, as shown in FIG. 7, the timing of the individual discharge pulse P1 for the small drop is deviated from the timing of the common discharge pulse P2 of the common driving signal. Further, the timing of the individual discharge pulse P1 of the individual driving signal for the middle drop is deviated from the timing of the common discharge pulse P2 of the common driving signal. In other words, the timings, at which the individual driving pulses P1 for the small drop and the middle drop fall, are deviated from the timing at which the common discharge pulse P2 of the common driving signal falls. Therefore, even when the electric potential of the common electrode 45 is changed in relation to the piezoelectric element 48 corresponding to the nozzle 25 for discharging the small drop or the middle drop, the electric potential change does not act so effectively on the application of the discharge energy to the ink. As described above, when the timings, at which the individual discharge pulses P1 for the small drop and the middle drop fall, are deviated from the timing at which the common discharge pulse P2 of the common driving signal falls, the actual discharge amount is scarcely increased in relation to the nozzle 25 which is scheduled to discharge the small drop or the middle drop, by the change of the electric potential of the common electrode 45.

In the embodiment described above, the inkjet head 4 corresponds to the liquid discharge apparatus of the present teaching. The channel unit 20 corresponds to the channel structure of the present teaching. The driver IC 64 corresponds to the driving device of the present teaching. The first electric potential V1 corresponds to the first high electric potential of the present teaching. The second electric potential V2 corresponds to the first low electric potential and the second low electric potential of the present teaching. The third electric potential V3 corresponds to the second high electric potential of the present teaching.

Next, an explanation will be made about modified embodiments in which various modifications are applied to the embodiment described above. However, those constructed in the same manner as those described in the foregoing embodiment are designated by the same reference numerals, any explanation of which will be appropriately omitted.

First Modified Embodiment

Figure 9:
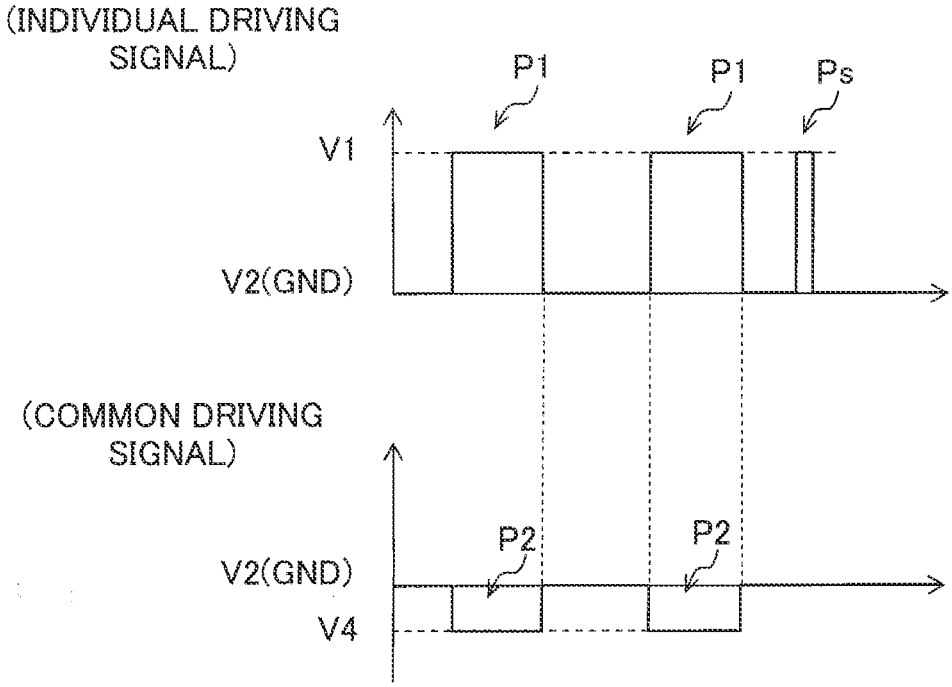
FIG. 9 shows waveforms of an individual driving signal and a common driving signal of a modified embodiment.

The waveforms of the individual driving signal and the common driving signal are not limited to those described in the foregoing embodiment. For example, as shown in FIG. 9, the common driving signal may be such a signal that the electric potential of the common electrode 45 is switched between the second electric potential V2 (GND) and a fourth electric potential V4 which is a negative electric potential lower than the second electric potential V2.

Further, the common driving signal may be such that the electric potential of the common electrode 45 is changed corresponding to not only the individual discharge pulse P1 of the individual driving signal but also the stabilizing pulse Ps. In this case, it is possible to shorten the pulse width of the stabilizing pulse Ps, and it is possible to shorten the discharge cycle thereby. In the embodiment described above, the driver IC 64 can generate the three types of the individual driving signals in accordance with the discharge amount of the ink to be discharged from the nozzle 25. However, the number of the individual driving signals is not limited to three. The number can be appropriately changed depending on the degree of fine setting of the ink discharge amount. Alternatively, it is also allowable to use one type of the individual driving signal.

Second Modified Embodiment

The construction of the piezoelectric actuator is not limited to those described in the foregoing embodiment. For example, in the foregoing embodiment, the construction is provided such that the plurality of piezoelectric elements 48, which are polarized in the thickness direction, exist on one piezoelectric layer 41, and the plurality of piezoelectric elements 48 are connected with each other. However, it is also allowable that the plurality of piezoelectric elements 48 are arranged while being separated from each other.

Further, the piezoelectric actuator may have a plurality of individual electrodes corresponding to a plurality of pressure chambers 26 respectively, and two types of common electrodes. For example, a piezoelectric actuator 21A shown in FIG. 10 has a piezoelectric member 40A which is composed of three piezoelectric layers 41A, 42A, 43A, individual electrodes 44A, a first common electrode 45A, and a second common electrode 46A. The individual electrodes 44A are arranged on the upper surface of the piezoelectric layer 41A which is disposed at the uppermost layer. The first common electrode 45A is arranged between the piezoelectric layer 41A which is disposed at the uppermost layer and the piezoelectric layer 42A which is disposed at the intermediate layer. The second common electrode 46A is arranged between the piezoelectric layer 42A which is disposed at the intermediate layer and the piezoelectric layer 43A which is disposed at the lowermost layer.

The individual electrode 44A and the first common electrode 45A are opposed to one another while interposing the piezoelectric layer 41A in the area overlapped with the central portion of the pressure chamber 26. The portion of the piezoelectric layer 41A, which is interposed between the individual electrode 44A and the first common electrode 45A, is referred to as "first piezoelectric element 48A". As shown by the blanked arrow a1 in FIG. 10, the first piezoelectric element 48A is polarized in the upward direction. The individual electrode 44A and the second common electrode 46A are opposed to one another while interposing the two piezoelectric layers 41A, 42A on the both sides of the first common electrode 45A. The portions of the two piezoelectric layers 41A, 42A, which are interposed between the individual electrode 44A and the second common electrode 46A, are referred to as "second piezoelectric element 49A". The second piezoelectric element 49A is polarized in the downward direction.

The driver IC 64 outputs the individual driving signal to the individual electrode 44A corresponding to the nozzle 25 for discharging the ink, while the driver IC 64 outputs the common driving signal to the first common electrode 45A. The individual driving signal has two individual discharge pulses P1'. Further, the common driving signal has two common discharge pulses P2' corresponding to the two individual discharge pulses P1' respectively. The driver IC 64 outputs the individual driving signal to the individual electrode 44A to switch the electric potential of the individual electrode 44A between the first electric potential V1' and the second electric potential V2'. In this modified embodiment, the first electric potential V1' is an electric potential which is lower than the second electric potential V2'. Specifically, the first electric potential V1' is the ground electric potential (GND). On the other hand, the driver IC 64 outputs the common driving signal to the first common electrode 45A to switch the electric potential of the first common electrode 45A between the second electric potential V2' and the third electric potential V3' in accordance with the electric potential change of the individual electrode 44A. The third electric potential V3' is an intermediate electric potential between the first electric potential V1' and the second electric potential V2'. That is, the magnitude correlation among the three types of the electric potentials is given as "second electric potential V2'>third electric potential>first electric potential V1' (GND)". The second common electrode 46A is always maintained at the first electric potential V1', and the electric potential thereof is not changed.

In this modified embodiment, the second electric potential V2' corresponds to the first high electric potential and the second high electric potential of the present teaching. The first electric potential V1' corresponds to the first low electric potential of the present teaching. The third electric potential V3' corresponds to the second low electric potential of the present teaching.

Figure 10:
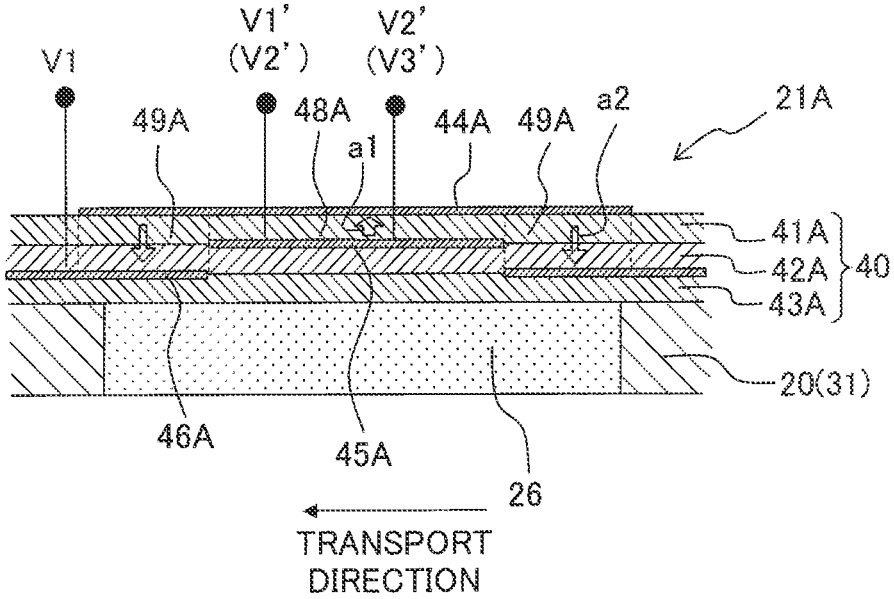
FIG. 10 shows a sectional view illustrating a piezoelectric actuator of another modified embodiment.
Figure 11:
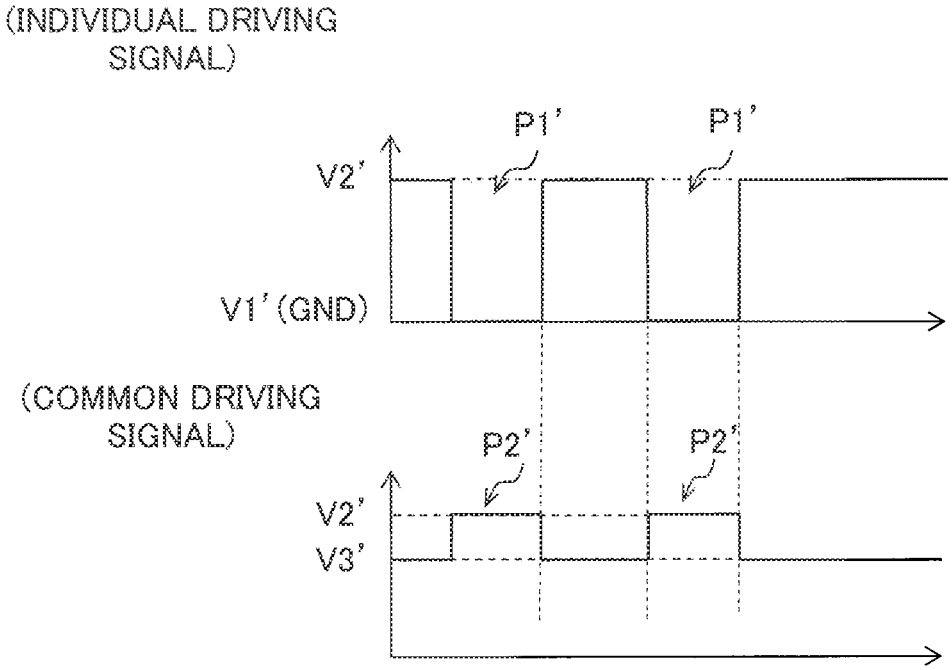
FIG. 11 shows waveforms of an individual driving signal and a common driving signal concerning the piezoelectric actuator shown in FIG. 10.
Figure 12A:
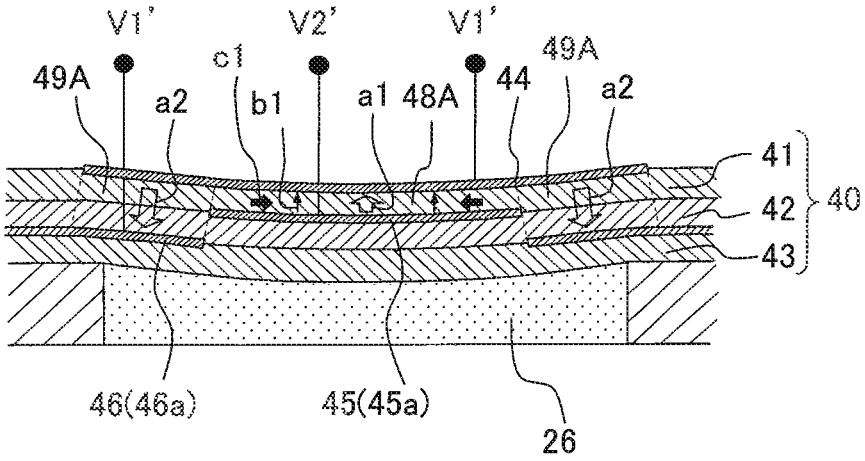
FIGS. 12A and 12B illustrate the operation of the piezoelectric actuator shown in FIG. 10.

FIG. 12 illustrates the operation of the piezoelectric actuator 21A shown in FIG. 10. When the individual discharge pulse P1' is applied to the individual electrode 44A, and the common discharge pulse P2' is applied to the first common electrode 45A, then the electric potential of the individual electrode 44A is the first electric potential V1', and the electric potential of the first common electrode 45A is the second electric potential V2' as shown in FIG. 12A (first state). In the first state, as shown by the arrows b1, the electric field in the upward direction is allowed to act on the first piezoelectric element 48A, and the direction of the electric field is coincident with the polarization direction of the first piezoelectric element 48A. Therefore, as shown by the arrows c1, the first piezoelectric element 48A is shrunk in the in-plane direction. Accordingly, the piezoelectric member 40A is warped so that the piezoelectric member 40A protrudes toward the side of the pressure chamber 26 (lower side), and the central portion thereof is displaced in the downward direction. The electric potential of the second common electrode 46A is always the first electric potential V1'. Therefore, any electric potential difference arises between the individual electrode 44A and the second common electrode 46A. Therefore, any deformation does not arise in the second piezoelectric element 49A.

Figure 12B:
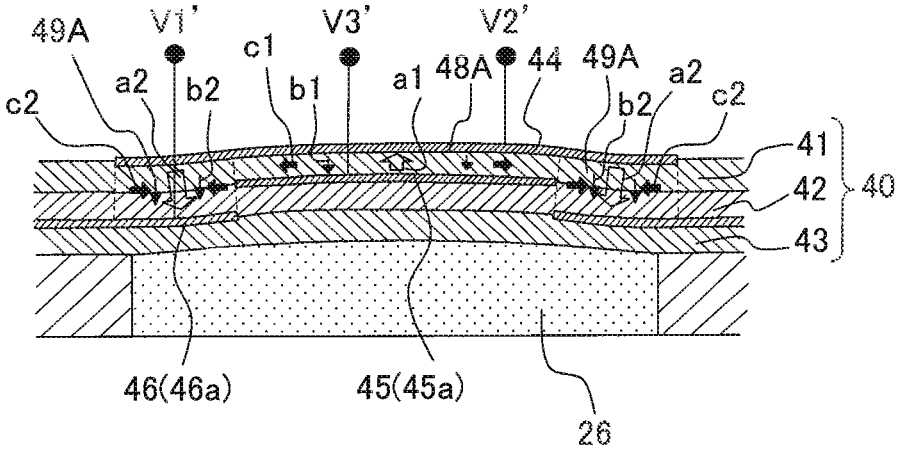

When the time, which corresponds to the pulse width of the individual discharge pulse P1' elapses, then the electric potential of the individual electrode 44A is the second electric potential V2', and the electric potential of the first common electrode 45A is the third electric potential V3' as shown in FIG. 12B (second state). Also in the second state, the electric potential difference arises between the individual electrode 44A and the first common electrode 45A. However, in this case, the electric potential of the individual electrode 44A is higher than the electric potential of the first common electrode 45A. Therefore, as shown by the arrows b1, the electric field in the downward direction is allowed to act on the first piezoelectric element 48A inversely to FIG. 12A, and the electric field is directed oppositely with respect to the polarization direction of the first piezoelectric element 48A. Therefore, as shown by the arrows c1, the first piezoelectric element 48A is elongated in the in-plane direction. Further, in this situation, the electric potential difference also arises between the individual electrode 44A and the second common electrode 46A. The electric field in the downward direction is allowed to act on the second piezoelectric element 49A as shown by the arrows b2, and the electric field is coincident with the polarization direction of the second piezoelectric element 49A. Therefore, the second piezoelectric element 49A is shrunk in the in-plane direction.

In this way, when the electric potential of the individual electrode 44A is switched from the first electric potential V1' to the second electric potential V2', then the first piezoelectric element 48A is elongated in the in-plane direction as shown in FIG. 12B from the state in which the first piezoelectric element 48A is shrunk in the in-plane direction as shown in FIG. 12A, while the second piezoelectric element 49A is conversely shrunk in the in-plane direction. Accordingly, the central portion of the piezoelectric member 40A is displaced in the upward direction.

Also in this modified embodiment, the electric potential of the first common electrode 45A is changed in accordance with the change of the electric potential of the individual electrode 44A in the same manner as in the embodiment described above. Therefore, the electric potential difference between the individual electrode 44A and the first common electrode 45A is increased with reference to FIG. 12A as compared with a case in which the electric potential of the first common electrode 45A is constant at the third electric potential V3'. Therefore, the amount of contraction in the in-plane direction of the first piezoelectric element 48A is increased, and the amount of displacement in the downward direction of the piezoelectric member 40A is increased. Further, the electric potential difference arises between the individual electrode 44A and the first common electrode 45A with reference to FIG. 12B as well, and hence the upward displacement arises in the piezoelectric member 40A, as compared with a case in which the electric potential of the first common electrode 45A is constant at the second electric potential V2'. In any case, the total displacement amount of the piezoelectric member 40A is increased as compared with any situation in which the electric potential of the first common electrode 45A is constant.

Third Modified Embodiment

In the embodiment described above, the following construction is provided. That is, the piezoelectric layers 41, 42 are arranged while ranging over the plurality of pressure chambers and the plurality of individual electrodes 44, and the plurality of piezoelectric elements 49, which correspond to the plurality of pressure chambers 26 respectively, are connected with each other. On the contrary, it is also allowable to provide such a construction that the plurality of piezoelectric elements 49, which are arranged corresponding to the plurality of pressure chambers 26 respectively, are separated from each other. The method for forming the plurality of piezoelectric elements 49 is not limited to the method in which the green sheets are sintered as exemplified in the embodiment described above. For example, the plurality of piezoelectric elements 49, the plurality of individual electrodes 44, the common electrode 45, and other components can be formed by forming films on a silicon substrate.

In the embodiment and the modified embodiments thereof explained above, the present teaching is applied to the inkjet head for printing, for example, an image by discharging inks onto the recording paper. However, the present teaching is also applicable to any liquid discharge apparatus to be used for various ways of use other than the printing of the image or the like. For example, the present teaching can be also applied to a liquid discharge apparatus for jetting a conductive liquid onto a substrate to form a conductive pattern on a surface of the substrate.

What is claimed is:

1. A liquid discharge apparatus configured to discharge liquid, comprising:

a channel structure in which a plurality of liquid channels including a plurality of nozzles is formed;

a piezoelectric actuator which is formed on the channel structure and which is configured so that discharge energy is applied to the liquid contained in the nozzles to discharge the liquid from the plurality of nozzles respectively, the piezoelectric actuator including:

a plurality of individual electrodes which correspond to the plurality of nozzles respectively and each of which is configured to be subjected to an electric potential, separately;

a common electrode which is configured to be subjected to a common electric potential; and a piezoelectric layer which is sandwiched between each of the individual electrodes and the common electrode; and a driving device which is configured to drive the piezoelectric actuator, the driving device being configured so that:

an individual driving signal, which causes a change of an electric potential of the individual electrodes, is output to each of the individual electrodes corresponding to one of the nozzles for discharging the liquid; and a common driving signal, which causes a change of an electric potential of the common electrode in synchronization with the change of the electric potential of the individual electrodes into which the individual driving signal is input, is output to the common electrode;

wherein portions of the piezoelectric layer sandwiched between the individual electrodes and the common electrode are polarized in a polarization direction;

wherein the individual driving signal is such a signal that the electric potential of the individual electrode is switched between a first electric potential and a second electric potential;

wherein the common driving signal is such a signal that the electric potential of the common electrode which is provided when the electric potential of the individual electrode is the first electric potential, is allowed to be the second electric potential, and that the electric potential of the common electrode, which is provided when the electric potential of the individual electrode is the second electric potential, is allowed to be a third electric potential which is intermediate between the first electric potential and the second electric potential;

wherein an electric field which has a direction coincident with the polarization direction, is allowed to act on the portions of the piezoelectric layer in a case that the portions of the piezoelectric layer are in a first state in which the electric potential of the individual electrode is the first electric potential and the electric potential of the common electrode is the second electric potential; and wherein an electric field, which has a direction opposite to the polarization direction, is allowed to act on the portions of the piezoelectric layer in a case that the portions of the piezoelectric layer are in a second state in which the electric potential of the individual electrode is the second electric potential and the electric potential of the common electrode is the third electric potential.

2. The liquid discharge apparatus according to claim 1;

wherein an amount of the change of the electric potential of the common electrode brought about when the common driving signal is output is smaller than an amount of the change of the electric potential of the individual electrode brought about when the individual driving signal is output.

3. The liquid discharge apparatus according to claim 1;

wherein the electric potential of the individual electrode into which the individual driving signal is input is switched between a first high electric potential and a first low electric potential which is lower than the first high electric potential;

wherein the electric potential of the common electrode into which the common driving signal is input is switched between a second high electric potential and a second low electric potential which is lower than the second high electric potential; and wherein the electric potential of the common electrode is the second low electric potential in a case that the electric potential of the individual electrode is the first high electric potential.

4. The liquid discharge apparatus according to claim 1;

wherein the individual driving signal has an individual discharge pulse which changes the electric potential of the individual electrode in order to apply the discharge energy to the liquid contained in the nozzle;

wherein the common driving signal has a common discharge pulse which changes the electric potential of the common electrode corresponding to the individual discharge pulse; and wherein an electric potential difference between the individual electrode and the common electrode is increased when the individual discharge pulse is applied to the individual electrode and the common discharge pulse is applied to the common electrode as compared with when only the individual discharge pulse is applied to the individual electrode.

5. The liquid discharge apparatus according to claim 4;

wherein a pulse width of the individual discharge pulse is equal to that of the common discharge pulse; and wherein the driving device applies the individual discharge pulse to the individual electrode, simultaneously with which the driving device applies the common discharge pulse to the common electrode.

6. The liquid discharge apparatus according to claim 1;

wherein the driving device is configured so that a plurality of types of the individual driving signals, which correspond to a plurality of liquid discharge amounts respectively, are generated, the driving device being configured so that one of the plurality of types of the individual driving signals is selected and output to one of the individual electrodes corresponding to one of the nozzles for discharging the liquid; and wherein the common driving signal is a signal which changes the electric potential of the common electrode in accordance with a change of the electric potential of the one of the individual electrodes provided when the individual driving signal corresponding to the largest liquid discharge amount is input.

7. The liquid discharge apparatus according to claim 6;

wherein the individual driving signal corresponding to the largest liquid discharge amount includes at least one individual driving pulse; and wherein the common driving signal includes at least one common driving signal pulses which is synchronized with one of the at least one individual driving pulses.

8. The liquid discharge apparatus according to claim 7;

wherein a number of the at least one common driving signal pulses is the same as a number of the at least one individual driving pulses, and each of the at least one common driving signal pulses is synchronized with one of the at least one individual driving pulses.

9. A liquid discharge method for discharging liquid by using a liquid display apparatus;

wherein the liquid display apparatus comprises:

a channel structure in which a plurality of liquid channels including a plurality of nozzles is formed; and a piezoelectric actuator which is formed on the channel structure and which is configured so that discharge energy is applied to the liquid contained in the nozzles to discharge the liquid from the plurality of nozzles respectively, the piezoelectric actuator including:

a plurality of individual electrodes which correspond to the plurality of nozzles respectively and each of which is configured to be subjected to an electric potential, separately;

a common electrode which is configured to be subjected to a common electric potential; and a piezoelectric layer which is sandwiched between each of the individual electrodes and the common electrode; and wherein the method comprises:

outputting an individual driving signal which causes a change of an electric potential of the individual electrodes, to each of the individual electrodes corresponding to one of the nozzles for discharging the liquid; and outputting a common driving signal which causes a change of an electric potential of the common electrode in synchronization with the change of the electric potential of the individual electrodes into which the individual driving signal is input, to the common electrode.

10. A liquid discharge apparatus configured to discharge liquid, comprising:

a channel structure in which a plurality of liquid channels including a plurality of nozzles is formed;

a piezoelectric actuator which is formed on the channel structure and which is configured so that discharge energy is applied to the liquid contained in the nozzles to discharge the liquid from the plurality of nozzles respectively, the piezoelectric actuator including:

a plurality of individual electrodes which correspond to the plurality of nozzles respectively and each of which is configured to be subjected to an electric potential, separately;

a common electrode which is configured to be subjected to a common electric potential; and a piezoelectric layer which is sandwiched between each of the individual electrodes and the common electrode; and a driving device which is configured to drive the piezoelectric actuator by:

outputting an individual driving signal, which causes a change of an electric potential of the individual electrodes, to each of the individual electrodes corresponding to one of the nozzles for discharging the liquid; and outputting a common driving signal to the common electrode, which causes a change of an electric potential of the common electrode in synchronization with the change of the electric potential of the individual electrodes into which the individual driving signal is input.

* * * * *

UNITED STATES PATENT AND TRADEMARK OFFICE

CERTIFICATE OF CORRECTION

PATENT NO. : 9,216,571 B2
APPLICATION NO. : 14/455140
DATED : December 22, 2015
INVENTOR(S) : Kyohei Naito et al.

It is certified that error appears in the above-identified patent and that said Letters Patent is hereby corrected as shown below:

In the claims,

At column 19, claim number 9, line number 2
"using a liquid display apparatus;"

should read:
--using a liquid discharge apparatus;--

At column 19, claim number 9, line number 3
"wherein the liquid display apparatus comprises:"

should read:
--wherein the liquid discharge apparatus comprises:--

Signed and Sealed this
Twenty-sixth Day of April, 2016

Michelle K. Lee

Michelle K. Lee
*Director of the United States Patent and Trademark Office*